US009501957B2

(12) United States Patent
Corbett

(10) Patent No.: US 9,501,957 B2
(45) Date of Patent: Nov. 22, 2016

(54) RECONFIGURABLE LABEL ASSEMBLY

(71) Applicant: Dawg'N Around, LLC, Newtown, PA (US)

(72) Inventor: Lee M. Corbett, Doylestown, PA (US)

(73) Assignee: Dawg'N Around, LLC, Newtown, PA (US)

( * ) Notice: Subject to any disclaimer, the term of this patent is extended or adjusted under 35 U.S.C. 154(b) by 0 days.

(21) Appl. No.: 15/175,085

(22) Filed: Jun. 7, 2016

(65) Prior Publication Data

US 2016/0284246 A1 Sep. 29, 2016

Related U.S. Application Data

(62) Division of application No. 14/419,537, filed as application No. PCT/US2013/051568 on Jul. 23, 2013, now Pat. No. 9,390,633.

(60) Provisional application No. 61/729,441, filed on Nov. 23, 2012, provisional application No. 61/680,300, filed on Aug. 7, 2012.

(51) Int. Cl.

| | |
|---|---|
| ***G09F 3/02*** | (2006.01) |
| ***B65D 25/20*** | (2006.01) |
| ***B65D 3/06*** | (2006.01) |
| ***B65D 3/20*** | (2006.01) |
| ***B65D 5/40*** | (2006.01) |
| ***B65D 30/00*** | (2006.01) |
| ***B65D 23/08*** | (2006.01) |

(52) U.S. Cl.

CPC . *G09F 3/02* (2013.01); *B65D 3/06* (2013.01); *B65D 3/20* (2013.01); *B65D 5/40* (2013.01); *B65D 23/0842* (2013.01); *B65D 25/20* (2013.01); *B65D 25/205* (2013.01); *B65D 31/00* (2013.01); *B65D 2203/02* (2013.01); *G09F 2003/0272* (2013.01); *G09F 2003/0273* (2013.01)

(58) Field of Classification Search

CPC ..... B65D 3/06; B65D 3/20; B65D 5/40; B65D 25/20; B65D 25/205; B65D 31/00; B65D 2203/02; G09F 3/02; G09F 3/04; G09F 3/14; G09F 2003/0272; G09F 2003/0273

USPC ..... 206/217, 218, 459.5; 40/310, 324; 215/DIG. 7; 229/4.5, 405

See application file for complete search history.

(56) References Cited

U.S. PATENT DOCUMENTS 3,120,918 A * 2/1964 Leonard ..... B65D 5/46032 229/117.22

3,430,844 A * 3/1969 Daniels ..... B65D 31/142 383/54

(Continued)

*Primary Examiner* — Bryon Gehman

(74) *Attorney, Agent, or Firm* — Michael Crilly, Esquire

(57) ABSTRACT

A reconfigurable label assembly including a container capable of storing or holding a liquid and a front panel, a back panel, a bottom panel, and side panels configured primarily as a label and secondarily as a receptacle capable of holding the liquid separate from the container is presented. In some embodiments, the bottom panel includes a fold. The bottom and side panels are disposed between and substantially parallel to the front panel and back panels in a first configuration to form a label attached to and separable from the container. The front and back panels are separable and the bottom and side panels are expandable to form a receptacle in a second configuration after the label is separated from the container. The side panels include additional folds facilitating transformation from a label to a receptacle and from a receptacle to a label.

9 Claims, 15 Drawing Sheets

(56) References Cited

U.S. PATENT DOCUMENTS 4,898,477 A * 2/1990 Cox ..... B65D 33/007 383/104
5,630,544 A * 5/1997 Shane ..... B65D 31/12 229/114
7,360,256 B1 * 4/2008 Jiles ..... A41B 13/10 206/542
8,065,826 B2 * 11/2011 Riis ..... B65D 23/085 215/DIG. 7
2010/0025456 A1 * 2/2010 McCann ..... B65D 31/10 229/117.06
2012/0132557 A1 * 5/2012 Nowzari ..... B65D 23/085 206/459.5

* cited by examiner

*Fig. 6*
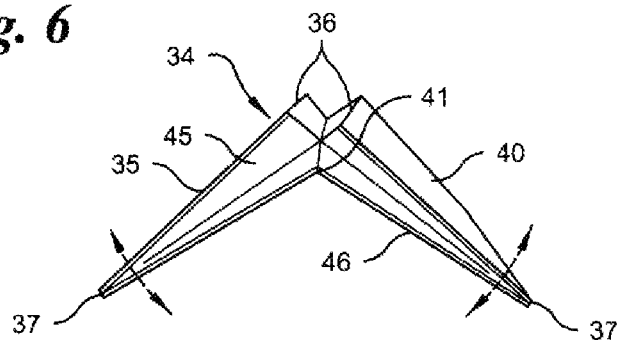
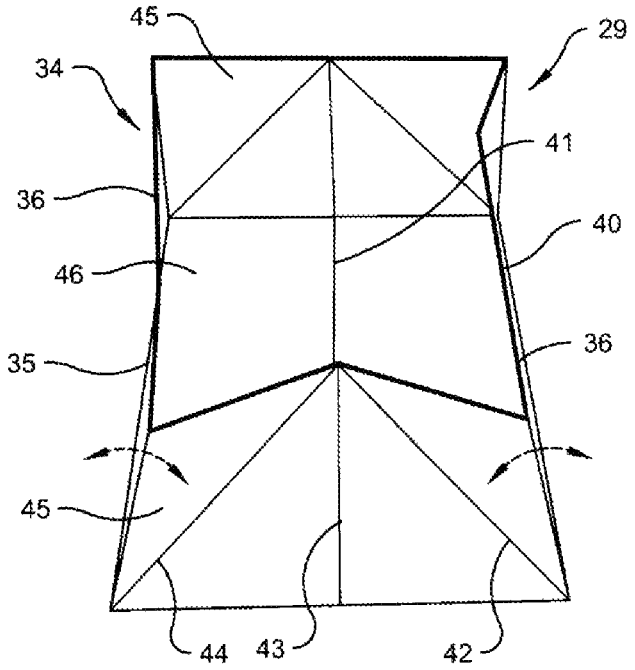
*Fig. 7*

RECONFIGURABLE LABEL ASSEMBLY

CROSS REFERENCE TO RELATED APPLICATIONS

This application is a divisional application of U.S. National Phase application Ser. No. 14/419,537 entitled Reconfigurable Label Assembly filed Feb. 4, 2015 which is based upon and claims priority from Patent Cooperation Treaty Application No. PCT/US2013/051568 entitled Reconfigurable Label Assembly filed Jul. 23, 2013 which further claims priority from U.S. Provisional Application Nos. 61/729,441 filed Nov. 23, 2012 and 61/680,300 filed Aug. 7, 2012, both entitled Reconfigurable Label. The subject matters of the prior applications are incorporated in their entirety herein by reference thereto.

FEDERALLY SPONSORED RESEARCH AND DEVELOPMENT

None.

BACKGROUND OF THE INVENTION

1. Field of the Invention

The invention generally relates to a label for use with a container that may include a bottle or a can. Specifically, the invention is a label applied to a container in a removable fashion. After separation from the container, the label may be unfolded to form a leak-proof receptacle, non-limiting examples including a cup or a bowl, capable of holding a liquid dispensed from the container. The leak-proof receptacle may be refolded to its original form, namely, a label with or without indicia for optional reattachment to the container. The label may be transformed from a label to a receptacle and from a receptacle to a label for multiple reuses.

2. Background

Riis et al. describes a label with a formable cup in U.S. Pat. No. 8,065,826. The label includes at least one cup sheet. Each cup sheet has an outer edge, a first surface, and a second surface, wherein at least one cup sheet is detachable from the label and assembled to form a cup.

As shown in FIG. 1, the label 1 includes several first cup sheets 2-5. Each cup sheet 2-5 has an outer edge 6-9, a first surface, and a second surface, respectively, wherein the cup sheets 2-5 are separately detachable from the label and separately assembled such that each cup sheet is formed into a separate cup. The label 1 has a label frame 10 which carries the cup sheets 2-5. The label frame 10 and the cup sheets 2-5 could form a part of the same layer. Thus, the label frame 10 comprises a first inner edge 11, a second inner edge 12, a third inner edge 13, and a fourth inner edge 14 forming a first separation line 15, a second separation line 16, a third separation line 17, and a fourth separation line 18 with the first outer edge 6, the second outer edge 7, the third outer edge 8, and the fourth outer edge 9, respectively. The size and shape of the cup sheets 2-5 could be the same or vary.

As shown in FIG. 2, a cup sheet 2 is detached from the label frame 10. The cup sheet 2 comprises a first part 19, a second part 20, a first fixation part 21, and a second fixation part 22. A first folding line 23 is provided between the first part 19 and the second part 20 to make forming of the cup sheet 2 easier. In some embodiments, the first fixation part 21 comprises a plurality of fixation tabs 24, and a second folding line 25 is provided between the fixation tabs 24 and the second part 20. The fixation tabs 24 are separated by cuts 26 extending from or near the second folding line 25 towards the outer edge 6 of the cup sheet 2. The cup sheet 2 has a first surface and a visible second surface 27. An adhesive is applied to the first surface of the fixation tabs 24 such that a part of the second surface of the first part 19 can be fixed to the fixation tabs 24 to form a watertight cup. Further, an adhesive is applied to the first surface of the second fixation part 22 such that a part of the second surface of the second part 20 can be fixed to the second fixation part 22 to form a watertight cup.

The label described by Riis et al. is problematic for at least the following reasons.

Riis et al. allows only a portion of a label to be configured into a cup. In doing so, Riis et al. limits the size of a resultant cup and provides a solution incapable of efficiently utilizing all materials comprising a label in both applications of the label.

Riis et al. requires a cup sheet to be physically separated from a label frame. In doing so, Riis et al. alters the aesthetic, commercial, and advertising utilities of the label after removal of one or more cup sheets. Also, a cup is incapable of being remounted onto a container after use without damage to the cup rendering it incapable of reuse.

Riis et al. requires various parts of a cup sheet to be bent and thereafter attached to other parts to form a cup. The assembly process is complicated and time consuming. Further, the resultant cup could leak if not properly assembled.

Riis et al. requires various parts of a cup sheet to be adhesively attached to other parts to form a cup. If parts are not properly joined, then the adhesive could contaminate liquid within a cup or stick to the user during use of a cup.

Riis et al. provides a label in sheet form including front and back surfaces. In doing so, Riis et al. substantially limits the total area available for advertising along a cup configured from a portion of a label.

Riis et al. provides a non-removable label with removable cup-like elements. In doing so, Riis et al. bifurcates the advertisement functionality and value of a label from the overall functionality and value of each cup.

Accordingly, what is required is a reconfigurable label assembly which is easily and quickly transformed in its entirety from a label to a leak-proof receptacle.

Accordingly, what is required is a reconfigurable label assembly which is easily and quickly transformed in its entirety from a leak-proof receptacle to a label.

Accordingly, what is required is a reconfigurable label assembly which maintains the aesthetic, commercial, and advertising utilities of a label when attached to a container as a label and when separated therefrom and configured as a leak-proof receptacle.

Accordingly, what is required is a reconfigurable label assembly which is transformable into a label after use as a receptacle and further capable of maintaining the aesthetic, commercial, and advertising utilities of the label in its original form.

Accordingly, what is required is a reconfigurable label assembly which is remountable as a label onto a container after use as a receptacle.

Accordingly, what is required is a reconfigurable label assembly which avoids adhesive joints and other assembly features that facilitate transformation of a label into a leak-proof receptacle and that prevent transformation of a leak-proof receptacle back to a label.

Accordingly, what is required is a reconfigurable label assembly which greatly increases the total area available for advertising when transformed into a leak-proof receptacle.

Accordingly, what is required is a reconfigurable label assembly whereby the advertisement functionality and value of the label are an integral part of the leak-proof receptacle.

SUMMARY OF THE INVENTION

An object of the invention is a reconfigurable label assembly which is easily and quickly transformed in its entirety from a label to a leak-proof receptacle.

An object of the invention is a reconfigurable label assembly which is easily and quickly transformed in its entirety from a leak-proof receptacle to a label.

An object of the invention is a reconfigurable label assembly which maintains the aesthetic, commercial, and advertising utilities of a label when attached to a container as a label and when separated therefrom and configured as a leak-proof receptacle.

An object of the invention is a reconfigurable label assembly which is transformable into a label after use as a receptacle and further capable of maintaining the aesthetic, commercial, and advertising utilities of the label in its original form.

An object of the invention is a reconfigurable label assembly which is remountable as a label onto a container after use as a receptacle.

An object of the invention is a reconfigurable label assembly for a container which avoids adhesive joints and other assembly features that facilitate transformation of a label into a leak-proof receptacle and that prevent transformation of a leak-proof receptacle back to a label.

An object of the invention is a reconfigurable label assembly for a container which greatly increases the total area available for advertising when transformed into a leak-proof receptacle.

An object of the invention is a reconfigurable label assembly whereby the advertisement functionality and value of the label are an integral part of the leak-proof receptacle.

In accordance with embodiments of the invention, the reconfigurable label assembly includes a container, a front panel, a back panel, and a bottom panel. The container is capable of storing a liquid without leakage. The front, back, and bottom panels are attached. The bottom panel is disposed between and substantially parallel to the front and back panels in a first configuration to form a label attached to and separable from the container. The front and back panels are separable and the bottom panel expandable to form a receptacle in a second configuration after the label is separated from the container. The receptacle is capable of holding the liquid without leakage. The receptacle is foldable to form the label in the first configuration.

In accordance with other embodiments of the invention, the container is a bottle.

In accordance with other embodiments of the invention, the container is a can.

In accordance with other embodiments of the invention, the front panel includes indicia viewable in the first and second configurations.

In accordance with other embodiments of the invention, the label is configurable for reuse as a receptacle.

In accordance with other embodiments of the invention, the receptacle is configurable for reuse as a label.

In accordance with other embodiments of the invention, the label is reattachable to the container after use as a receptacle.

In accordance with other embodiments of the invention, the bottom panel includes a first fold parallel to the front and back panels. The bottom panel is expandable via the first fold.

In accordance with other embodiments of the invention, front, back, or bottom panel includes indicia viewable in the second configuration.

In accordance with other embodiments of the invention, the front and back panels are joined by a pair of first seams. The front and back panels are separately joined to the bottom panel by a second seam. The first and second seams prevent leakage of the liquid from the receptacle in the second configuration.

In accordance with other embodiments of the invention, the first and second seams are ultrasonic welds.

In accordance with other embodiments of the invention, the invention includes a pair of side panels. The side panels are further attached to the front, back, and bottom panels. The side panels are disposed between and substantially parallel to the front and back panels in the first configuration to form the label. The side panels are expandable to form the receptacle in the second configuration.

In accordance with other embodiments of the invention, each side panel includes a second fold which intersects the first fold at a first end of the second fold. Each side panel includes third and fourth folds which intersect at a second end of the second fold. The third fold is angularly oriented along each side panel from the intersection between the front and bottom panels to the second end. The fourth fold is angularly oriented along each side panel from the intersection between the back and bottom panels to the second end. The second fold is oppositely foldable with respect to the third and fourth folds. The side panels are foldable via the second, third, and fourth folds to form the label in the first configuration. Each second fold overlays a portion of the first fold in the first configuration. The side panels are unfoldable via the second, third folds, and fourth folds to form the receptacle in the second configuration.

In accordance with other embodiments of the invention, each side panel includes a second fold which intersects the first fold at a first end of the second fold. Each side panel includes third and fourth folds which intersect at a second end of the second fold. The third fold is angularly oriented along each side panel from the intersection between the front and bottom panels to the second end. The fourth fold is angularly oriented along each side panel from the intersection between the back and bottom panels to the second end. The second fold is oppositely foldable with respect to the third and fourth folds. Each side panel includes a fifth fold which intersects the second end and extends therefrom. The fifth fold is oppositely foldable with respect to the second fold. The side panels are foldable via the second, third, fourth, and fifth folds to form the label in the first configuration. The second folds separately overlay the first fold in the first configuration. The side panels are unfoldable via the second, third, fourth, and fifth folds to form the receptacle in the second configuration.

In accordance with other embodiments of the invention, the label is reattachable to the container after use as a receptacle.

In accordance with other embodiments of the invention, front, back, side, or bottom panel includes indicia viewable in the second configuration.

In accordance with embodiments of the invention, the reconfigurable label assembly includes a container, a front panel, a back panel, a bottom panel, and a pair of side panels. The front, back, bottom, and side panels are attached. The back panel includes a first fold parallel to the front and bottom panels. The side and back panels are disposed between and substantially parallel to the front panel and bottom panels in a first configuration to form a label attached to and separable from the container. The front and bottom panels are separable and the side and back panels are expandable via the first fold to form a receptacle in a second configuration after the label is separated from the container. The receptacle is capable of holding the liquid without leakage. The receptacle is foldable to form the label in the first configuration.

In accordance with other embodiments of the invention, each side panel includes a second fold which intersects the first fold at a first end of the second fold. Each side panel includes third and fourth folds which intersect at a second end of the second fold. The third fold is angularly oriented along each side panel from the intersection between the front and bottom panels to the second end. The fourth fold is angularly oriented along each side panel from intersection between the back and bottom panels to the second end. The second fold is oppositely foldable with respect to the third and fourth folds. Each side panel includes a fifth fold which intersects the second end and extends therefrom. The fifth fold is oppositely foldable with respect to the second fold. The side panels are foldable via the second, third, fourth, and fifth folds to form the label in the first configuration. The second folds separately overlay the first fold in the first configuration. The side panels are unfoldable via the second, third, fourth, and fifth folds to form the receptacle in the second configuration.

In accordance with other embodiments of the invention, the front panel includes indicia viewable in the first and second configurations.

In accordance with other embodiments of the invention, the label is configurable for reuse as a receptacle.

In accordance with other embodiments of the invention, the receptacle is configurable for reuse as a label.

In accordance with other embodiments of the invention, front, back, side, or bottom panel includes indicia viewable in the second configuration.

In accordance with other embodiments of the invention, the label is reattachable to the container after use as a receptacle.

Several advantages are offered by the invention. The invention provides a portable, self-contained hydration solution applicable to persons and/or to pets. The label may be unfolded or refolded two or more times enabling reuse as both a means of advertising or communicating instructions and other information and a means for consuming a liquid separate from the container. The various panels required for the receptacle are disposed within a compact form which minimizes the thickness of the label thereby maintaining the form factor and volume of a typical bottle or can. The invention is applicable to non-consumable liquids.

The above and other objectives, features, and advantages of the preferred embodiments of the invention will become apparent from the following description read in connection with the accompanying drawings, in which like reference numerals designate the same or similar elements.

BRIEF DESCRIPTION OF THE DRAWINGS

Additional aspects, features, and advantages of the invention will be understood and will become more readily apparent when the invention is considered in the light of the following description made in conjunction with the accompanying drawings.

FIG. 6 is a side view illustrating a reconfigurable label partially unfolded during transformation into a receptacle in accordance with an embodiment of the invention.

FIG. 7 is a side elevation view illustrating a reconfigurable label nearly completely unfolded during transformation into a receptacle in accordance with an embodiment of the invention.

DETAILED DESCRIPTION OF THE INVENTION

Figure 1:
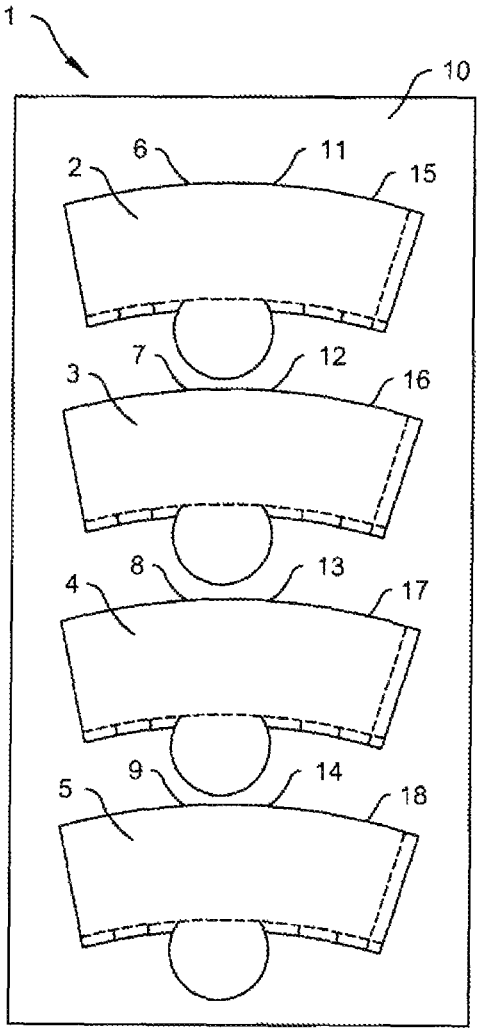
Fig. 1 (Prior Art)
FIG. 1 is a top view of a label from the prior art with cup sheets removably attached thereto.
Figure 2:
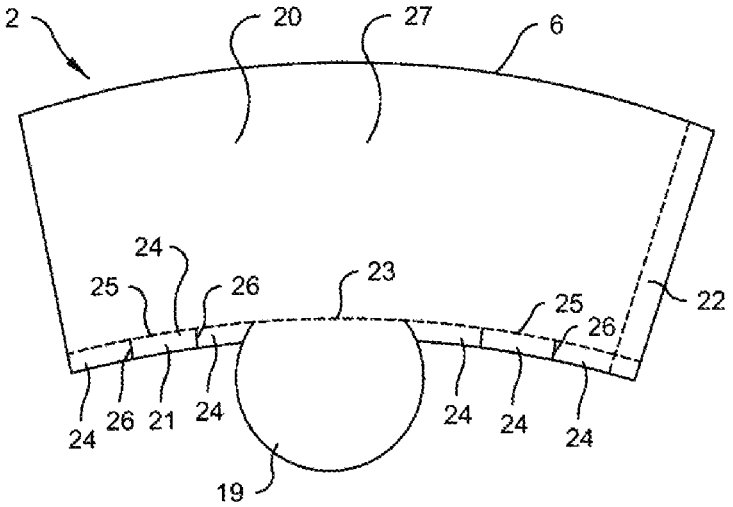
Fig. 2 (Prior Art)
FIG. 2 is a top view of a cup sheet from the prior art before assembly to form a cup.

Reference will now be made in detail to several embodiments of the invention that are illustrated in the accompanying drawings. Wherever possible, same or similar reference numerals are used in the drawings and the description to refer to the same or like parts. The drawings are in simplified form and are not to precise scale.

While features of various embodiments are separately described throughout this document, it is understood that two or more such features could be combined into a single embodiment.

Figure 3:
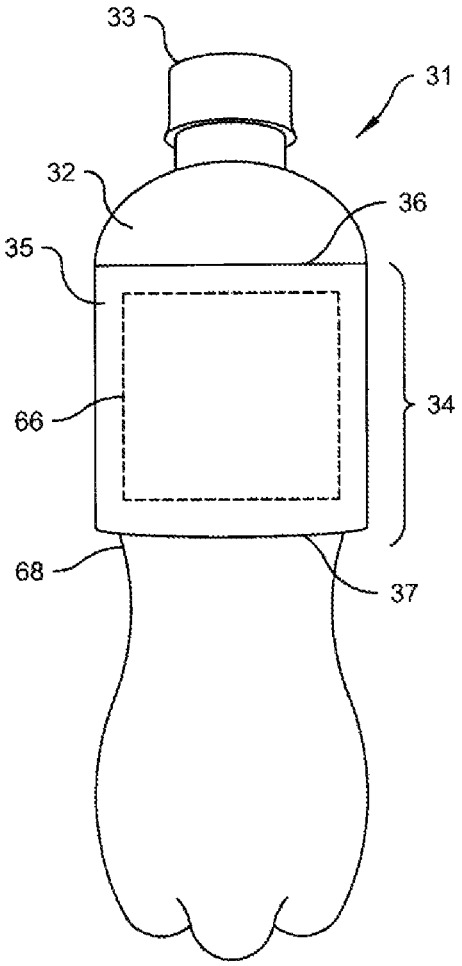
FIG. 3 is a side view illustrating a reconfigurable label assembly whereby a label is attached about a circumference of a container in a removable fashion in accordance with an embodiment of the invention.
Figure 4:
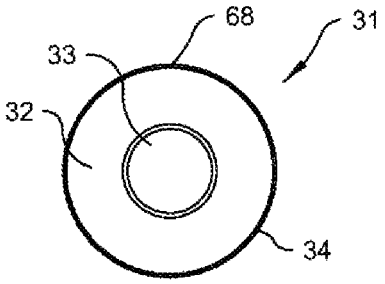
FIG. 4 is a top view illustrating a reconfigurable label assembly whereby a label is attached about a circumference of a container in a removable fashion in accordance with an embodiment of the invention.

Referring now to FIGS. 3 and 4, the reconfigurable label assembly 31 is illustrated including a container 32 with an optional cap 33 and a label 34. The container 32 could be any device capable of holding and storing a liquid, non-limiting examples of the latter including water or soda. The container 32 could be composed of a deformable or rigid material, non-limiting examples including soft plastics, hard plastics, glass, or metal. The label 34 could be an element of sheet wise construction which is bendable or pliable so as to conformably contact the outer surface of the container 32. For example, the label 34 may conform to the circumference 68 of a container 32 so as to cover a portion of the center region of the container 32 as represented in FIG. 3 or the label 34 could substantially cover the container 32 in other embodiments. The label 34 may further include indicia 66 (generally represented by the region identified by reference numeral 66) completely or partially covering the front panel 35 of the label 34 between the top edge 36 and bottom edge 37 of the label 34, as represented in FIG. 3. The indicia 66 may include words, designs, pictures, bar coding, and/or any item which visually communicate information to an observer or a device held by an observer. In one example, indicia 66 could include product related information, designs, and/or trademarks. In another example, indicia 66 could include instructional information pertaining to the label 34 and its use and reuse. In yet another example, indicia 66 could include a code which launches content viewable on a smartphone or the like. The label 34 could be fabricated via one or more materials which are impermeable. Preferably, materials could be recyclable and disposable. Exemplary materials include, but are not limited to, plastic, wax coated paper, or waterproof cardboard.

Figure 5B:
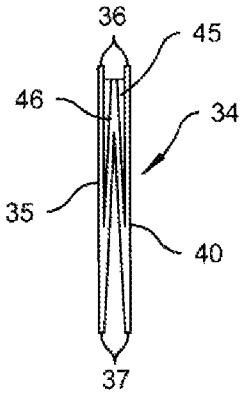
FIG. 5*b* is a side view illustrating the profile of a reconfigurable label configured as a label in accordance with an embodiment of the invention.
Figure 5A:
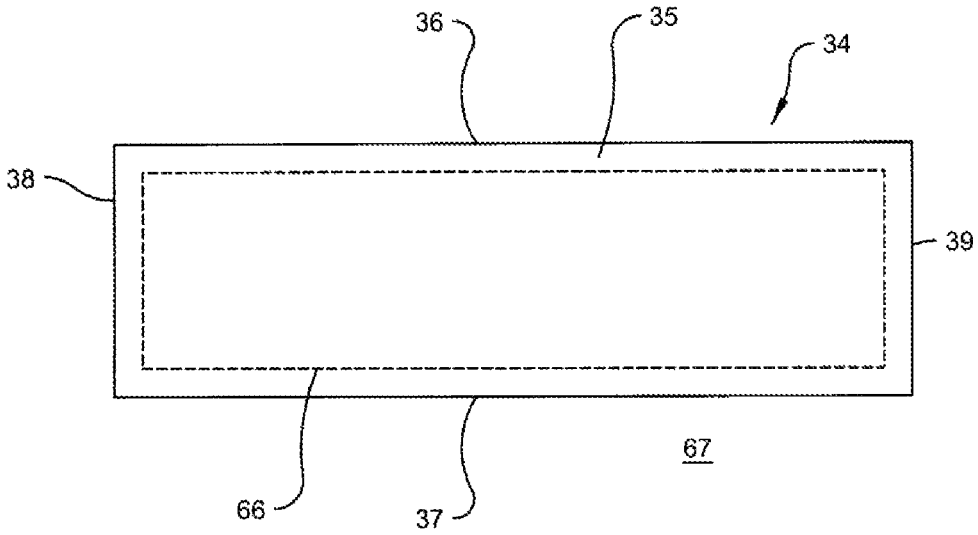
FIG. 5*a* is a front view illustrating a reconfigurable label disposed along a planar surface after removal from a container and prior to transformation into a receptacle in accordance with an embodiment of the invention.

Referring now to FIGS. 5*a* and 5*b*, an embodiment of a label 34 with indicia 66 is shown disposed along a planar surface 67 so that a front panel 35 is clearly visible and a back panel 40 contacts the planar surface 67. The label 34 is disposed in a collapsed configuration so that the front and back panels 35, 40 are disposed about a pair of side panels 45 and a bottom panel 46. The panels 35, 40, 45, 46 are closely spaced and substantially parallel so as to form a structure of nominal thickness, as represented in FIG. 5*b*, which minimizes extension of the label 34 from the container 32. In one non-limiting example, each panel 35, 40, 45, 46 may be 1 to 4 mils thick. The label 34 is bounded by a top edge 36, a bottom edge 37, and a pair of side edges 38, 39. The edges 36-39 generally define the area visible when the label 34 is attached to a container 32. Although a rectangular-shaped label 34 is illustrated in FIG. 5*a*, other shapes are possible.

Referring now to FIG. 6, a label 34 is partially unfolded by rotating the front and back panels 35, 40 away outward adjacent to the bottom edge 37, as illustrated by the arrows. This motion causes the bottom edges 37 to separate and the top edges 36 to move closer. The bottom panel 46 assumes a v-shaped arrangement pivoting about a fold 41 which traverses the length of the label 34, also see FIG. 7. The fold 41 is substantially parallel to the front and back panels 35, 40. The front and back panels 35, 40 are also slightly separated from the bottom panel 46 to display a side panel 45 in a substantially collapsed and folded condition. The label 34 is folded by moving the bottom edges 37 inward toward each other.

Referring now to FIG. 7, a label 34 is nearly completely unfolded by further rotating the front and back panels 35, 40 away from each other adjacent to the top edge 36. The bottom panel 46 is nearly planar so that the fold 41 forms an obtuse angle approaching 180 degrees. The front and back panels 35, 40 are oriented nearly perpendicular relative to a planar surface. The side panels 45 are nearly completely unfolded. Each side panel 45 includes a fold 43 which traverses the height of the side panel 45 and intersects with the fold 41 along the bottom panel 46. Each side panel 45 also includes a pair of inclined folds 42, 44 which intersect the fold 43 at the top end of the side panel 45. The fold 44 also intersects the corner formed between the front panel 35 and the bottom panel 46. The fold 42 also intersects the bottom panel 46 and between the back panel 40 and the bottom panel 46. It is also possible to transform the label 34 into a receptacle 29 by separating the front and back panels 35, 40 which in turn cause relative rotation motion whereby the bottom panel 46 is expanded and the side panels 45 extended.

The side panels 45 unfold outward and refold inward along folds 42, 44. The bottom panel 46 unfolds downward and folds upward via the transverse fold 41. Folds 42, 44 and fold 41 are disposed in opposite directions. The side panels 45 unfold from and refold onto the bottom panel 46 via the fold 43. Folds 43, 41 overlap when configured as a label 34.

Figure 8:
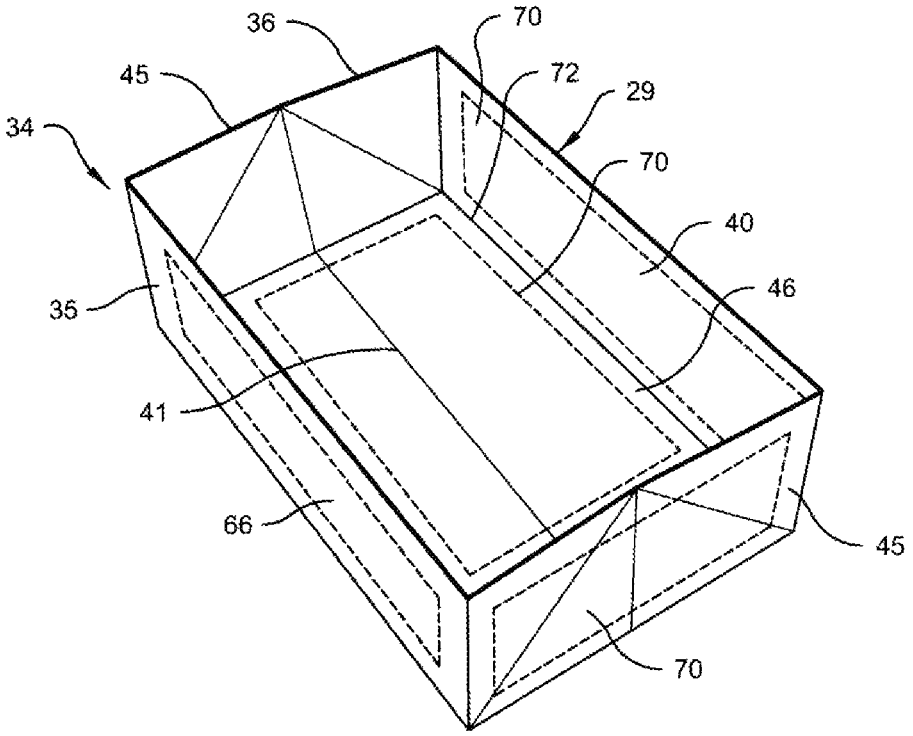
FIG. 8 is a perspective view illustrating a reconfigurable label fully unfolded to form a receptacle with a pair of side panels, a front panel, and a back panel attached to a bottom panel in accordance with an embodiment of the invention.

Referring now to FIG. 8, a label 34 is shown in a fully unfolded condition forming a receptacle 29 capable of holding a liquid in a leak-proof manner. The front, back and side panels 35, 40, 45 are disposed in a substantially perpendicular arrangement with respect to the now substantially planar bottom panel 46. The front, back, and side panels 35, 40, 45 are attached to the bottom panel 46 about its perimeter 72. The front and back panels 35, 40 are attached at opposing ends to each of the side panels 45. Attachment between various panels 35, 40, 45, 46 is possible via molding, bonding, ultrasonic welding, forming, or other suitable methods. The indicia 66 along the front panel 35 are clearly visible. Additional indicia 70 (generally represented by the region identified by reference numeral 70) could be provided along the back, side, and/or bottom panels 40, 45, 46 as illustrated in FIG. 8.

When unfolded, the various panels 35, 40, 45, 46 are sufficiently rigid so as to substantially maintain the desired shape of the receptacle 29. The shape and rigidity of the receptacle 29 is further ensured by the forces applied by a liquid within the receptacle 29.

Figure 9:
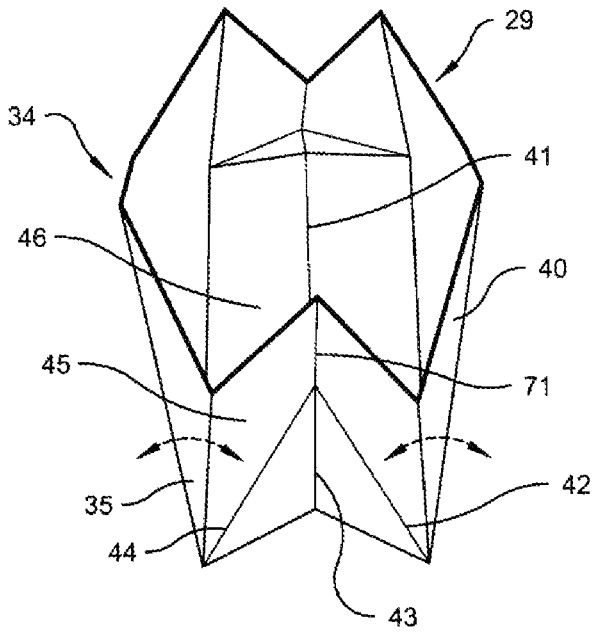
FIG. 9 is a side elevation view illustrating a reconfigurable label partially unfolded during transformation into a receptacle in accordance with an embodiment of the invention.

Referring now to FIG. 9, an alternate embodiment is illustrated for the side panels 45 of the label 34 configurable into a receptacle 29. A fold 71 is disposed along the side panel 45 so as to partially traverse the height of the side panel 45. The fold 71 is further disposed in a parallel arrangement with respect to the front and back panels 35, 40. Another fold 43 is disposed along the side panel 45 and collinear with the fold 71 so as to intersect the fold 71 at one end and the fold 41 at another end, the latter traversing the bottom panel 46. The folds 43, 71 are disposed in opposite directions. The folds 42, 44 are disposed in an inclined arrangement along the side panel 45. One end of the fold 44 intersects the point where the folds 43, 71 meet and another end intersects the corner formed between the front panel 35 and bottom panel 46. One end of the fold 42 intersects the point where folds 43, 71 meet and another end intersects the corner formed between the back panel 40 and bottom panel 46. Folds 43, 41 overlap when configured as a label 34. Folds 71, 42, 44 are foldable in the same direction and are oppositely foldable from the fold 43.

In this embodiment, the label 34 is unfolded by separating the front and back panels 35, 40 and folded by joining the front and back panels 35, 40, as illustrated by the arrows in FIG. 9. The side panels 45 unfold outward and fold inward along the folds 42, 43, 44, 71. The bottom panel 46 unfolds downward and folds upward via the transverse fold 41. A portion of the side panel 45 folds onto the bottom panel 46 via the fold 43 so that the folds 43, 41 overlap. The front, back, and side panels 35, 40, 45 are folded by moving the front and back panels 35, 40 toward one another, as illustrated by the arrows in FIG. 9.

Figure 10:
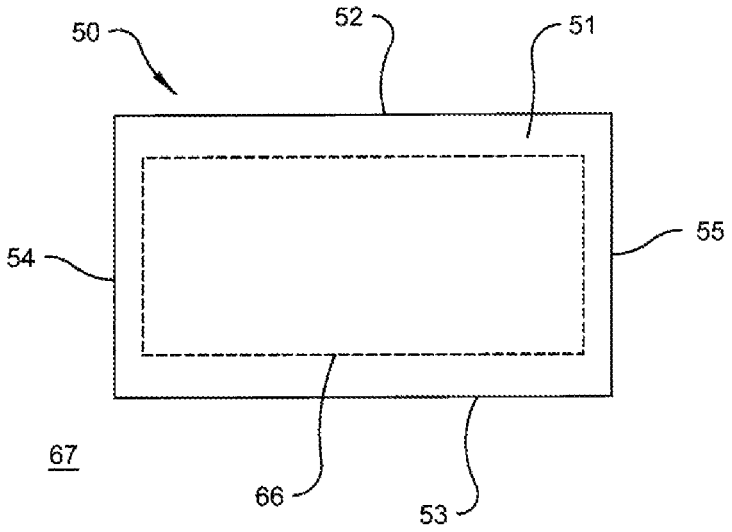
FIG. 10 is a top view illustrating a reconfigurable label disposed along a planar surface after removal from a container and prior to transformation into a receptacle in accordance with an embodiment of the invention.

Referring now to FIG. 10, the front panel 51 of an alternate label 50 is shown including a top edge 52, a bottom edge 53, a pair of side edges 54, 55 and optional indicia 66, as otherwise described herein, disposed along a planar surface 67.

Figure 11:
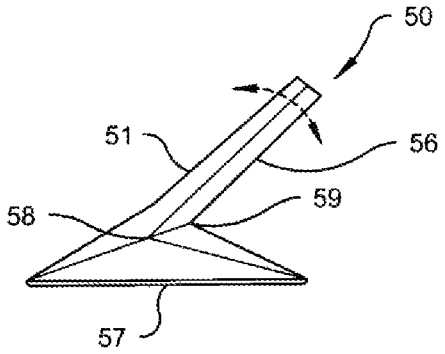
FIG. 11 is a side view illustrating a reconfigurable label partially unfolded during transformation into a receptacle in accordance with an embodiment of the invention.

Referring now to FIG. 11, the label 50 is shown in a partially unfolded condition. The front and bottom panels 51, 57 are substantially planar disposed elements. The back panel 56 includes a fold 59 which traverses the back panel 56 separating two substantially planar portions. This arrangement allows the back panel 56 to fold onto itself when configured for use as a label 50 so that the front and bottom panels 51, 57 are disposed in a substantially parallel arrangement about the back and side panels 56, 58.

Figure 12:
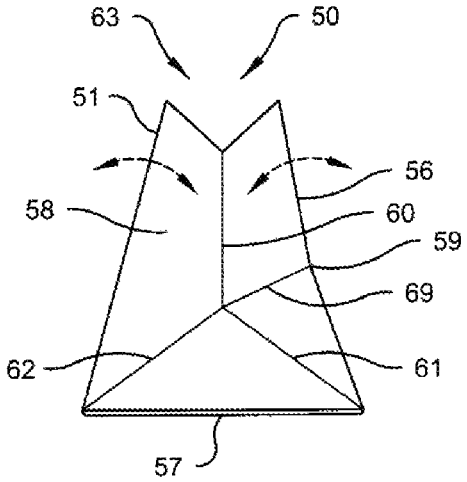
FIG. 12 is a side view illustrating a side panel of a reconfigurable label nearly completely unfolded during transformation into a receptacle in accordance with an embodiment of the invention.

Referring now to FIG. 12, the label 50 is shown in a substantially unfolded configuration for use as a leak-proof receptacle 63. Each side panel 58 includes a fold 60 which partially traverses the height of the side panel 58. Each side panel 58 also includes a pair of folds 61, 62 disposed at an incline. One fold 62 intersects the lower end of the fold 60 at a first end and intersects the corner formed between the front and bottom panels 51, 57 at a second end. The other fold 61 intersects the lower end of the fold 60 at a first end and intersects the corner formed between the back and bottom panels 56, 57 at a second end. A fourth fold 69 is provided along each side panel 58 so as to intersect the intersection of folds 60, 61, 62 at one end and intersect the fold 59 at the other end. Folds 60-62 are configured to collapse in a direct opposite from the fold 69.

Figure 13:
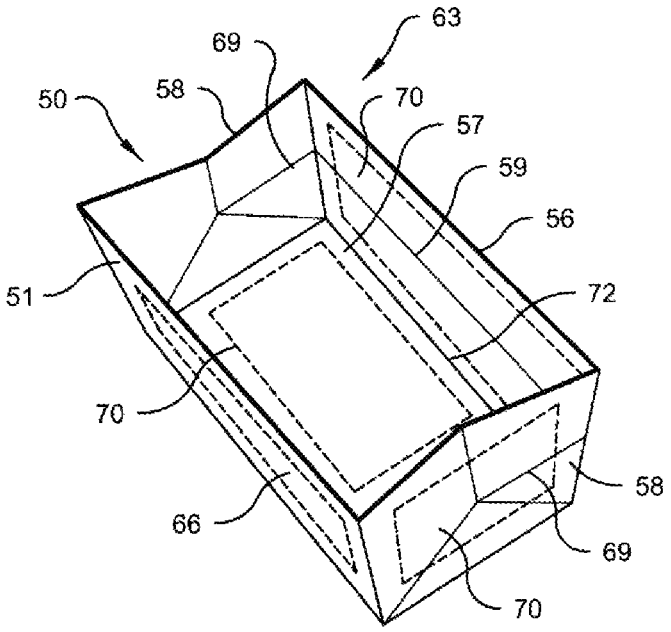
FIG. 13 is a perspective view illustrating a reconfigurable label fully unfolded to form a receptacle with a pair of side panels, a front panel, and a back panel attached to a bottom panel in accordance with an embodiment of the invention.

Referring now to FIG. 13, the label 50 is shown in a fully unfolded condition forming a receptacle 63 capable of holding a liquid in a leak-proof manner. The front, back, and side panels 51, 56, 58 are disposed in a substantially perpendicular arrangement with respect to the now substantially planar bottom panel 57. The front, back, and side panels 51, 56, 58 are attached to the bottom panel 57 about the perimeter 72 of the bottom panel 57. The front and back panels 51, 56 are attached at opposing ends to each of the side panels 58. Attachment between various panels 51, 56, 57, 58 could be made via molding, bonding, ultrasonic welding, forming, or other suitable methods. The indicia 66 along the front panel 51 are clearly visible. Additional indicia 70 could be provided along the back, side, or bottom panels 56, 58, 57 as illustrated in FIG. 13.

When unfolded, the front, back, bottom, and side panels 51, 56, 57, 58 are sufficiently rigid so as to substantially maintain the desired shape of the receptacle 63. The shape and rigidity of the receptacle 63 is further ensured by the forces applied by a liquid within the receptacle 63.

In this embodiment, the label 50 is unfolded by rotating the back panel 56 away from itself as illustrated by the arrow in FIG. 11 and separating the front and back panels 51, 56 as illustrated by the arrows in FIG. 12. The side panels 58 fold inward and unfold outward via the folds 60, 61, 62, 69. Each back panel 56 folds onto and unfolds away or expands from itself via the fold 59. A portion of each side panel 58 folds onto the back panel 56 via overlap of the folds 59 and 69.

Figure 14:
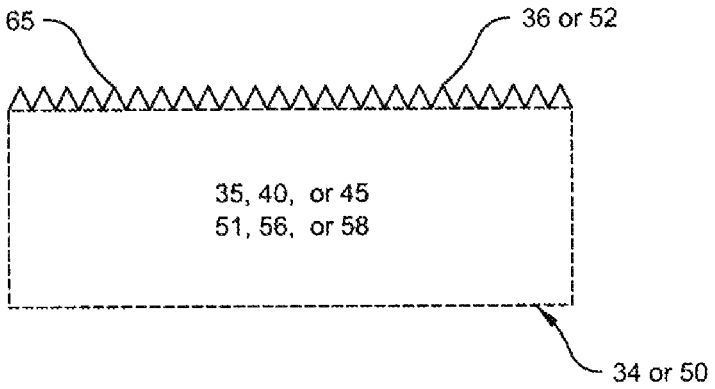
FIG. 14 is a side view illustrating a front, back or side panel along a receptacle with a scalloped edge in accordance with an embodiment of the invention.

Referring now to FIG. 14, one or more panels 35, 40, 45, 51, 56, 58, and/or others described herein could include a scalloped edge 65 or other non-linear feature along the top edge 36, 52 of the label 34, 50 to minimize cuts to a user which might result from a linear edge.

Figure 15:
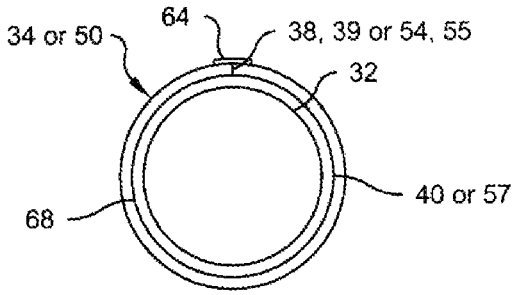
FIG. 15 is a section view through the circumference of a container illustrating attachment of a reconfigurable label in its fully collapsed form disposed about and attached to the outer circumference of a container in accordance with an embodiment of the invention.

The labels described herein are attachable in various configurations. In one example, a label 34, 50 and others described herein could completely surround the circumference 68 of a container 32 so that the side edges 38, 39 or 54, 55, respectively, abut, as represented in FIG. 15. In other embodiments, the side edges 38, 39 or 54, 55 could overlap or terminate so as to expose a portion of the container 32 between the side edges 38, 39 or 54, 55.

The various labels may be secured to a container 32 via several means. In one example, tape 64 could be applied to overlap the opposed side edges 38, 39 or 54, 55 of a label 34 or 50, respectively, as represented in FIG. 15. The label 34, 50 could be pulled tight onto the container 32 so that frictional forces secure the label 34, 50 to the container 32. In other embodiments, adhesive could be applied between the back panel 40 and container 32 or the bottom panel 57 and container 32. The back panel 40 contacts the container 32 with regard to the embodiments described in FIGS. 3-9. The bottom panel 57 contacts the container 32 with regard to the embodiments described in FIGS. 10-13. In yet other embodiments, an adhesive strip or tabs could secure overlapping side edges 38, 39 or 54, 55. In still other embodiments, the side edges 38, 39 or 54, 55 could include interlocking tabs or hook-like extensions which facilitate attachment of the label 34, 50 to a container 32.

Figure 16:
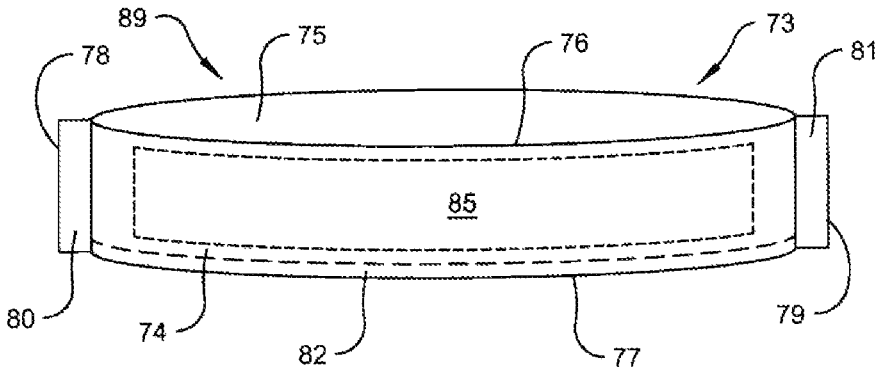
FIG. 16 is a top perspective view illustrating a reconfigurable label unfolded to form a receptacle including a front panel, a back panel, and a bottom panel in accordance with an embodiment of the invention.
Figure 17:
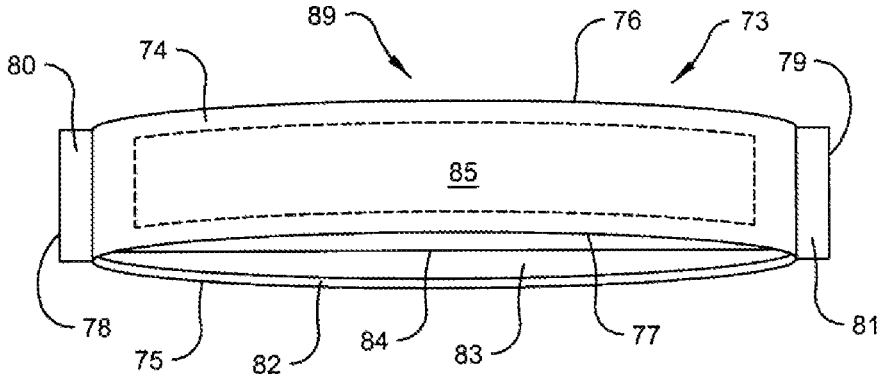
FIG. 17 is a bottom perspective view further illustrating the reconfigurable label in FIG. 16.
Figure 18:
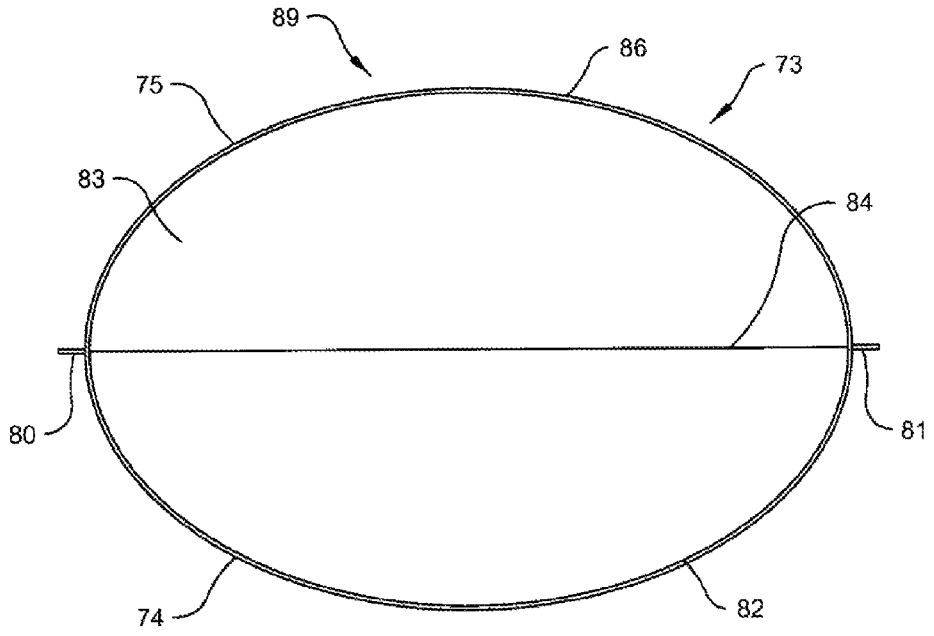
FIG. 18 is a top view illustrating a reconfigurable label fully unfolded so that a front panel and a back panel are disposed about the perimeter of a bottom panel thereby forming a receptacle capable of containing a liquid without leakage in accordance with an embodiment of the invention.

Referring now to FIGS. 16 and 17, a label 73 is shown separate from a container 32 and expanded to form a receptacle 89, examples including but not limited to a bowl or cup, capable of holding a liquid without leakage. The label 73 is attachable and reattachable to a container 32 as described for other embodiments. The label 73 includes a front panel 74 and a back panel 75 which form the sides of the receptacle 89. The front and back panels 74, 75 are generally rectangular-shaped elements, although other shapes are possible, composed of a bendable material which is water resistant or waterproof, examples including, but not limited to, plastic and wax coated paper. The label 73 further includes a bottom panel 83 which forms the bottom of the receptacle 89. The bottom panel 83 may be a circular or elliptical shaped element, although other shapes are possible, composed of a bendable material which is likewise water resistant or waterproof. The bottom panel 83 may cause the front and back panels 74, 75 to be generally arcuate when the label 73 is unfolded thereby defining the shape of the receptacle 89. The shape of the receptacle 89 is design dependent and generally defined by the shape of the bottom panel 83. The bottom panel 83 may further include a fold 84 which partially or completely traverses the width of the bottom panel 83. The back panel 75 contacts the container 32 with respect to the embodiments described in FIGS. 16-23*c*.

Figure 19:
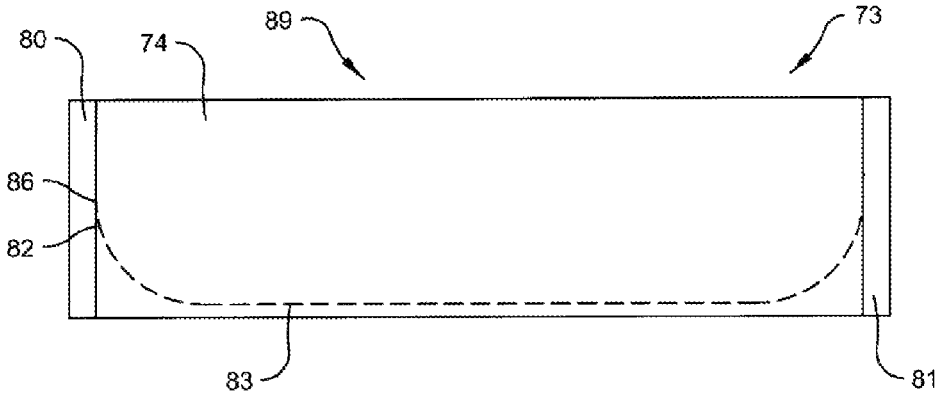
FIG. 19 is a side view of the reconfigurable label in FIG. 18 illustrating arrangement of the bottom panel within receptacle.

Referring now to FIGS. 16-19, the opposed side edges 78, 79 along the front panel 74 are aligned with and attached to likewise disposed side edges 78, 79 along the back panel 75. The leftmost overlapping side edges 78 of the front and back panels 74, 75 may be attached via an adhesive or ultrasonic weld to form a side seam 80, preferably forming a watertight seal. The rightmost overlapping side edges 79 along the front and back panels 74, 75 may also be attached via an adhesive or ultrasonic weld to form a watertight seam 81. Side seams 80, 81 are generally disposed along the length of the respective side edges 78, 79 where the front and back panels 74, 75 overlap and contact. The perimeter 86 of the bottom panel 83 contacts and overlaps the inner surface of the front and back panels 74, 75 adjacent to the bottom edges 77. The overlap may include a portion of the bottom panel 83 oriented upward or downward, the former shown in FIG. 23*b*, with a seam 82 formed along the overlap. The perimeter 86 may be attached to the front and back panels 74, 75 along the overlap via an adhesive or ultrasonic weld to form a watertight seam 82. The bottom panel 83 could be disposed at a substantially horizontal arrangement that intersects the front and back panels 74, 75 so that the front and back panels 74, 75 extend above the bottom panel 83. In preferred embodiments, the bottom panel 83 intersects the front and back panels 74, 75 at a substantially perpendicular or oblique angle. The bottom panel 83 is biased toward the bottom edges 77 of the front and back panels 74, 75 and away from the top edges 76. In some embodiments, the bottom panel 83 may be attached to the front and back panels 74, 75 so that the bottom panel 83 and seam 82 are disposed in an inclined arrangement immediately adjacent to the side seams 80, 81, as represented in FIG. 19. The capacity of the receptacle 89 is defined approximately by the top edge 76, the bottom panel 83, and the perimeter 86 of the bottom panel 83 with adjustments for any inclines adjacent to the side edges 78, 79. The seams 80, 81, 82 ensure that the receptacle 89 formed by the front, back, and bottom panels 74, 75, 83 is capable of holding a liquid without leakage.

In yet other embodiments, a rectangular-shaped bottom panel 83 may be folded lengthwise along the fold 84 and placed between rectangular-shaped front and back panels 74, 75. The bottom panel 83 may partially overlap the front and back panels 74, 75 starting at or near the bottom edges 77 with the fold 84 oriented toward the top edges 76. The front panel 74, back panel 75, and bottom panel 83 may be joined via side seams 80, 81 adjacent to side edges 78, 79, respectively. Approximately one half of the bottom panel 83 is joined to the front panel 74 and the remainder is joined to the back panel 75. The central and outer portions of one half of the bottom panel 83 may be ultrasonically welded to the front panel 74 adjacent to the bottom edge 77 along a seam 82. The outer portions may be welded along an angled orientation oriented upward and toward each side seam 80, 81. The central and outer portions of one half of the bottom panel 83 may be ultrasonically welded to the back panel 75 adjacent to the bottom edge 77 along a seam 82. The outer portions may be welded along an angled orientation upward and toward each side seam 80, 81. The seams 80, 81, 82 allow the front and back panels 74, 75 to be separated and the bottom panel 83 to unfold thereby forming a receptacle 89 whereby the bottom panel 83 is biased toward the bottom edge 77.

Figure 20:
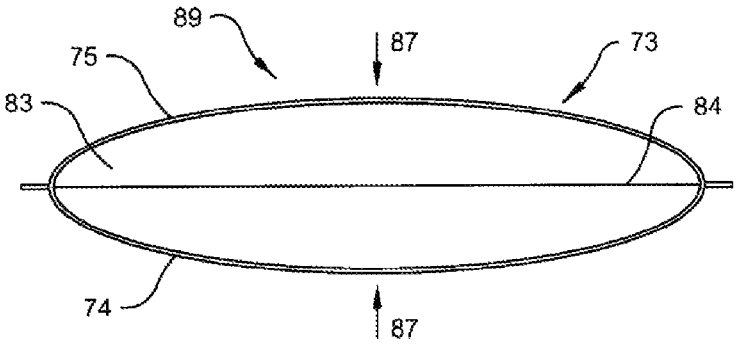
FIG. 20 is a top view illustrating a reconfigurable label partially collapsed in accordance with an embodiment of the invention.

Referring now to FIG. 20, the receptacle 89 is shown partially collapsed during reconfiguration as a label 73. The receptacle 89 is collapsed by applying an inward closing force 87 along the front and back panels 74, 75 in the direct of the fold 84. The fold 84 ensures that the bottom panel 83 folds generally half-wise and moves upward between the front and back panels 74, 75 when collapsed.

Figure 21:
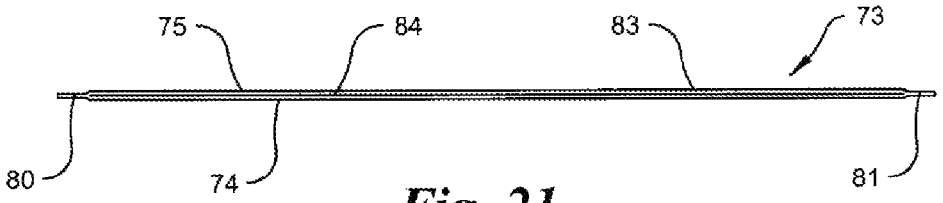
FIG. 21 is a top view illustrating a reconfigurable label fully collapsed so that a bottom panel is disposed in a parallel planar arrangement between the front and back panels in accordance with an embodiment of the invention.
Figure 22:
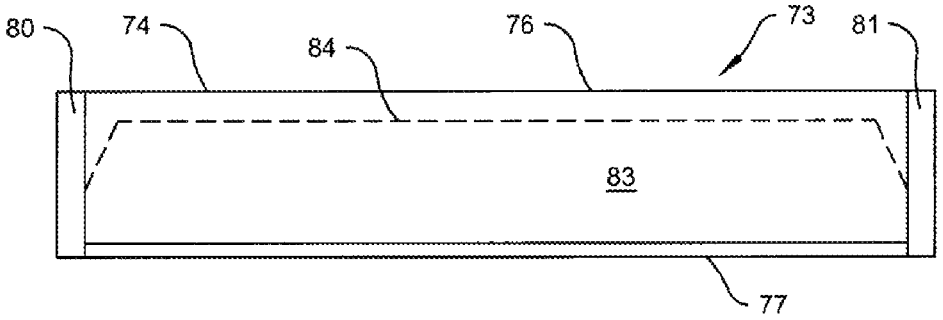
FIG. 22 is a side view of the reconfigurable label in FIG. 21 illustrating the bottom panel in a folded arrangement along the length of the label.

Referring now to FIGS. 21 and 22, the label 73 is shown in its full collapsed condition. The label 73 is now substantially planar with a profile substantially equal to the rectangular shape of the front and back panels 74, 75, as represented in FIG. 22, and a thickness approximately equal to the sum of the thicknesses for the front panel 74, the back panel 75, and twice the bottom panel 83, as represented in FIG. 21. In one non-limiting example, each panel 74, 75, 83 may be 1 to 4 mils thick. The indicia 85 (generally represented by the region identified by reference numeral 85) shown along the front panel 74 in FIG. 16 would be clearly visible along the collapsed label 73. When fully collapse, the bottom panel 83 is folded in half and substantially parallel to the front and back panels 74, 75, as represented in FIG. 22, with the fold 84 oriented toward the top edge 76. The bottom panel 83 could partially or completely overlap the height of the front and back panels 74, 75, depending on the shape and dimensions of the bottom panel 83.

Figure 23A:
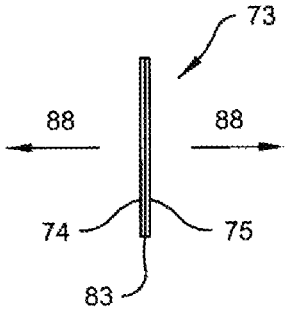
FIG. 23*a* is a cross section view illustrating a reconfigurable label collapsed to form a planar-shaped label in accordance with an embodiment of the invention.
Figure 23B:
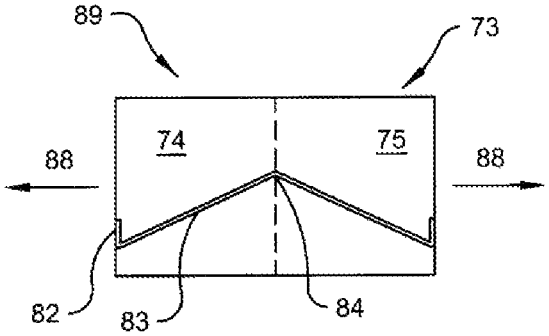
FIG. 23*b* is a cross section view of the reconfigurable label in FIG. 23*a* partially unfolded so that the bottom panel is partially expanded between the front and back panels.
Figure 23C:
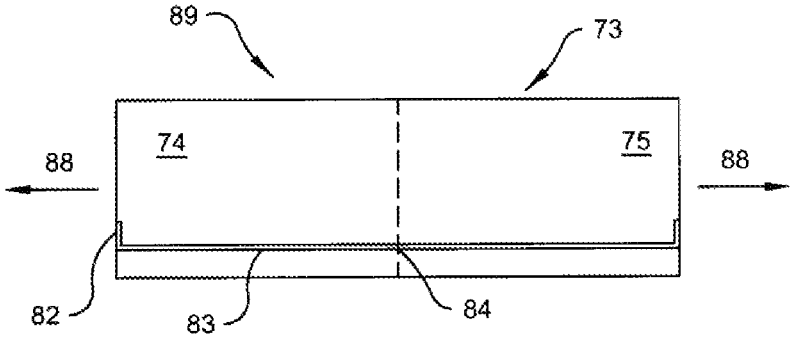
FIG. 23*c* is a cross section view of the reconfigurable label in FIG. 23*a* fully unfolded so that the bottom panel is completed expanded and horizontally disposed between the front and back panels so as to form a receptacle.

The label 73 is expanded to form a receptacle 89 by applying an outward opening force 88 onto the front and back panels 74, 75, as represented in FIG. 23*a*. The opening force 88 causes the front and back panels 74, 75 to separate from the bottom panel 83, as represented in FIG. 23*b*. The bottom panel 83 unfolds along the fold 84 as the distance between the front and back panels 74, 75 increases. When the front and back panels 74, 75 are completely separated, at least a portion of the bottom panel 83 may form a substantially horizontal element, as represented in FIG. 23*c*.

As is evident from the explanation herein, the described invention is a transformable label assembly wherein a label has secondary functionality as a receptacle, examples including but not limited to a cup or bowl, after detachment from a container. Accordingly, the described invention is expected to be applicable as a means for consuming various liquids by persons or pets.

The description above indicates that a great degree of flexibility is offered in terms of the present invention. Although various embodiments have been described in considerable detail with reference to certain preferred versions thereof, other versions are possible. Therefore, the spirit and scope of the appended claims should not be limited to the description of the preferred versions contained herein.

What is claimed is:

1. A reconfigurable label assembly comprising:

(a) a container being capable of storing a liquid without leakage;

(b) a front panel;

(c) a back panel;

(d) a bottom panel including a first fold, said bottom panel expandable via said first fold; and (e) a pair of side panels;

wherein said front panel, said back panel, and said bottom panel are attached, said side panels are further attached to said front panel, said back panel, and said bottom panel, said bottom panel disposed between and substantially parallel to said front panel and said back panel in a first configuration to form a label attached to and being completely separable from said container, said side panels disposed between and substantially parallel to said front panel and said back panel in said first configuration to form said label, said front panel and said back panel being separable and said bottom panel being expandable to form a receptacle in a second configuration after said label is separated from said container, said receptacle being capable of holding the liquid without leakage, said side panels expandable to form said receptacle in said second configuration, said label completely surrounds a circumference of said container in said first configuration and being configurable to form said receptacle in said second configuration, said front panel includes indicia completely viewable along said label in said first configuration and along said receptacle in said second configuration, said receptacle in said second configuration being configurable to said label in said first configuration after use as said receptacle in said second configuration so that said label in said first configuration is directly reattachable to said container.

2. The reconfigurable label assembly of claim 1, wherein said container is a bottle.

3. The reconfigurable label assembly of claim 1, wherein said container is a can.

4. The reconfigurable label assembly of claim 1, wherein said label is configurable for reuse as said receptacle.

5. The reconfigurable label assembly of claim 1, wherein said back panel and said bottom panel include indicia viewable in said second configuration.

6. The reconfigurable label of claim 1, wherein each said side panel includes a second fold which intersects said first fold at a first end of said second fold, each said side panel includes a third fold and a fourth fold which intersect at a second end of said second fold, said third fold angularly oriented along each said side panel from said second end to a first corner formed by said front panel and said bottom panel to said second end, said fourth fold angularly oriented along each said side panel from said second end to a second corner formed by said back panel and said bottom panel, said second fold oppositely foldable with respect to said third fold and said fourth fold, said side panels foldable via said second folds, said third folds, and said fourth folds to form said label in said first configuration, each said second fold separately overlays said first fold in said first configuration, said side panels unfoldable via said second folds, said third folds, and said fourth folds to form said receptacle in said second configuration.

7. The reconfigurable label of claim 1, wherein each said side panel includes a second fold which intersects said first fold at a first end of said second fold, each said side panel includes a third fold and a fourth fold which intersect at a second end of said second fold, said third fold angularly oriented along each said side panel from said second end to a first corner formed by said front panel and said bottom panel, said fourth fold angularly oriented along each said side panel from said second end to a second corner formed by said back panel and said bottom panel, said second fold oppositely foldable with respect to said third fold and said fourth fold, each said side panel includes a fifth fold which intersects said second end and extends therefrom, said fifth fold oppositely foldable with respect to said second fold, said side panels foldable via said second folds, said third folds, said fourth folds, and said fifth folds to form said label in said first configuration, said second folds separately overlay said first fold along in said first configuration, said side panels unfoldable via said second folds, said third folds, said fourth folds, and said fifth folds to form said receptacle in said second configuration.

8. The reconfigurable label assembly of claim 1, wherein said label is reattachable to said container after each use as said receptacle.

9. The reconfigurable label assembly of claim 1, wherein one of said back panel, said side panel, and said bottom panel includes indicia viewable in said second configuration.

* * * * *